US006808084B2

(12) United States Patent
Horn et al.

(10) Patent No.: US 6,808,084 B2
(45) Date of Patent: Oct. 26, 2004

(54) BINGO CARD MARKER IMPLEMENT

(76) Inventors: Kim Horn, 13100 SW. 33rd Ct., Davie, FL (US) 33330; Michael M. Anthony, 10189 W. Sample Rd., Coral Springs, FL (US) 33065

( * ) Notice: Subject to any disclaimer, the term of this patent is extended or adjusted under 35 U.S.C. 154(b) by 32 days.

(21) Appl. No.: 10/385,326

(22) Filed: Mar. 11, 2003

(65) Prior Publication Data

US 2004/0178215 A1 Sep. 16, 2004

(51) Int. Cl.[7] ..... B65G 59/00
(52) U.S. Cl. ..... 221/289; 401/196

(58) Field of Search ..... 221/289, 294, 221/277, 259; 401/196, 199, 200; 273/269

(56) References Cited

U.S. PATENT DOCUMENTS

D381,042 S * 7/1997 Roche ..... D19/51
5,899,624 A * 5/1999 Thompson ..... 401/206

* cited by examiner

*Primary Examiner*—Kenneth Noland
(74) *Attorney, Agent, or Firm*—Oltman, Flynn & Kubler

(57) ABSTRACT

A marker implement for applying a distinctive visual mark on a Bingo card at any number the player realizes he or she has mistakenly marked as having been called when in fact it was not.

17 Claims, 12 Drawing Sheets

BINGO CARD MARKER IMPLEMENT

BACKGROUND OF THE INVENTION

Field of the Invention

This invention relates to a hand-held marker implement for use by a player in the game commonly known as Bingo, in which competing players have cards with arrays of different numbers thereon to be marked by each player as a particular number on his or her card is called.

SUMMARY OF THE INVENTION

The present invention is directed to a novel hand-held marker implement for use with a game card having an array of numbers thereon and having provision for a player to distinctively mark any number he or she has previously marked erroneously when in fact that number had not been called.

A principal object of this invention is to provide a novel and advantageous hand-held marker implement for use by a Bingo player to apply a distinctive visual marker on his or her card at any erroneously marked number thereon so that the player will disregard that number as the game goes on.

In a presently preferred embodiment of the invention the implement holds a stack of thin, flat, annular marker disks, each with a self-adhesive face for attachment to the game card when one end of the implement is pressed against the game card to dispense a single marker disk. In other embodiments of the invention the implement has two marker applicators on its opposite ends, one for marking numbers on the game card as they are called and the other for making a different distinctive mark on any number the player realizes he or she has just marked by mistake.

Further aspects and advantages of this invention will be apparent from the following detailed description of three embodiments thereof, with reference to the accompanying drawings.

DETAILED DESCRIPTION OF THE INVENTION

Before explaining the present invention in detail it is to be understood that the invention is not limited in its application to the particular arrangements shown and described since the invention is capable of other embodiments. Also, the terminology used herein is for the purpose of description and not of limitation.

First Embodiment—FIGS. 1–6

Figure 1:
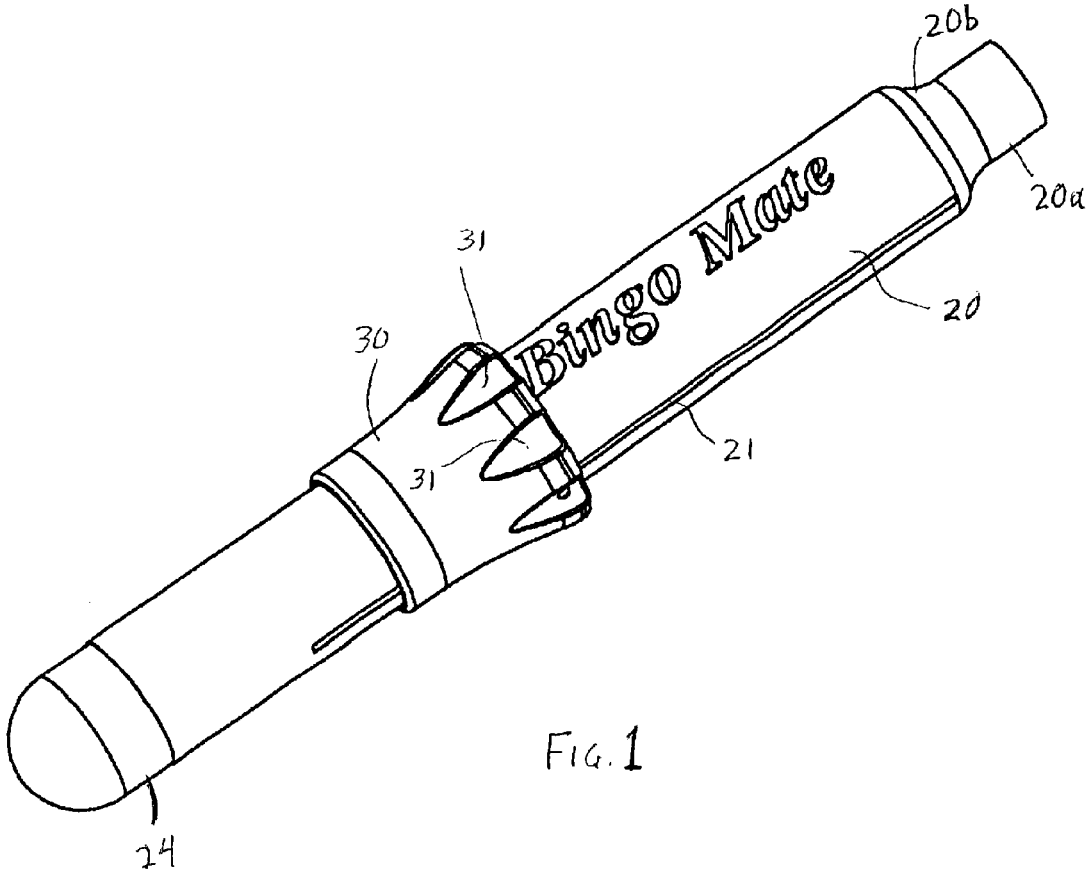
FIG. 1 is a perspective view of a marker implement in accordance with a preferred first embodiment of the present invention.
Figure 2:
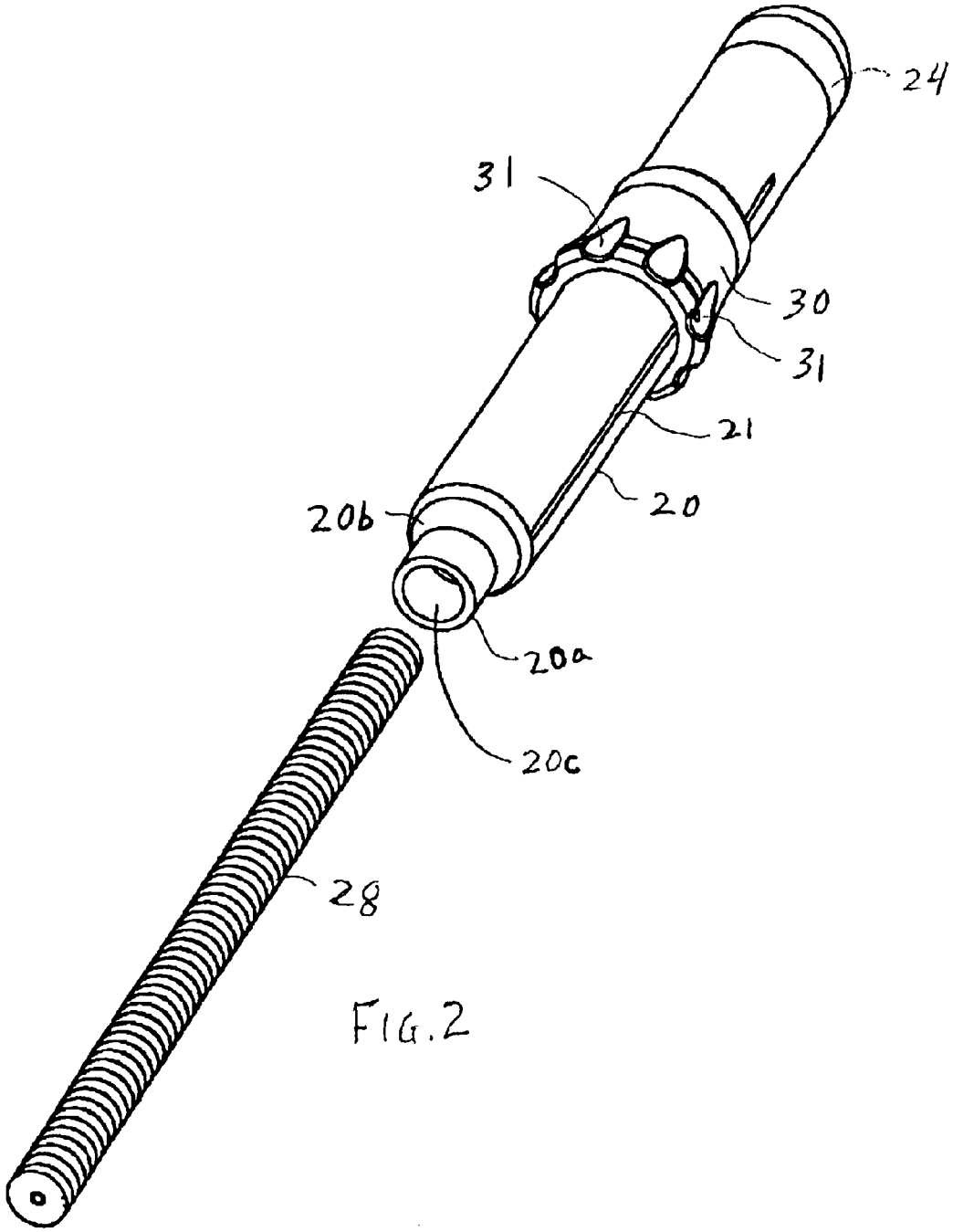
FIG. 2 is a perspective view of this marker implement with its stacked marker disks or stickers removed from the implement housing.
Figure 3:
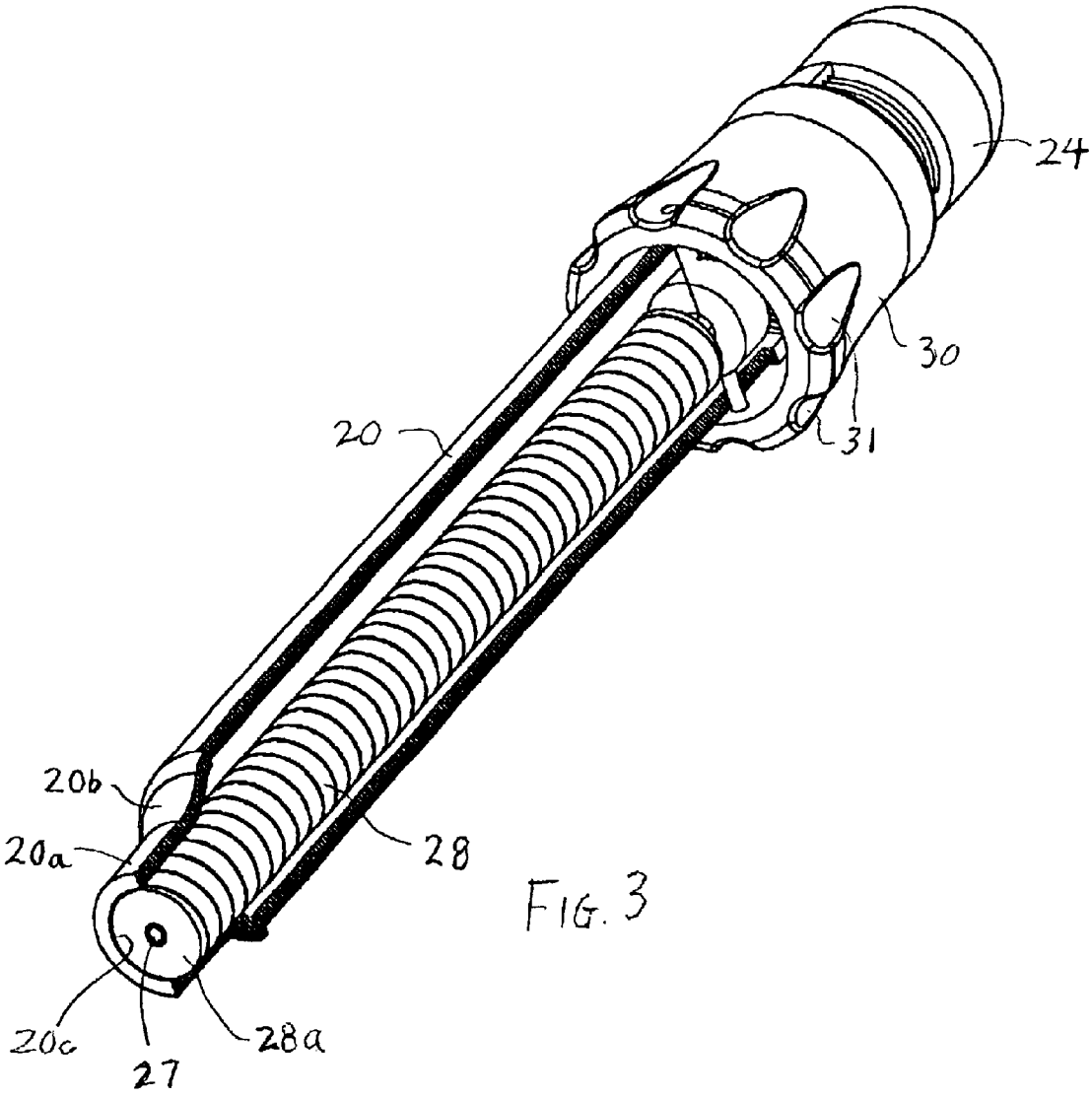
FIG. 3 is a perspective view of this marker implement with its housing broken open along most of its length to show operating parts of the marker implement.
Figure 4:
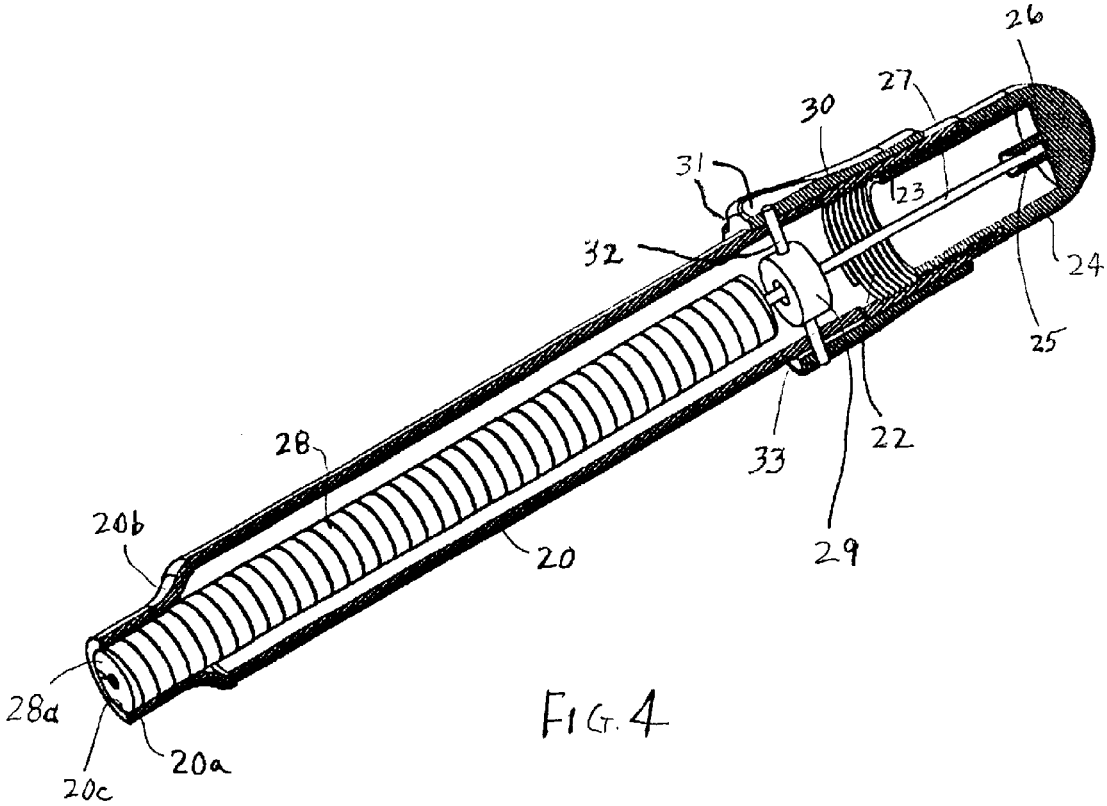
FIG. 4 is a perspective view of this marker implement with its housing broken open along its entire length.
Figure 5:
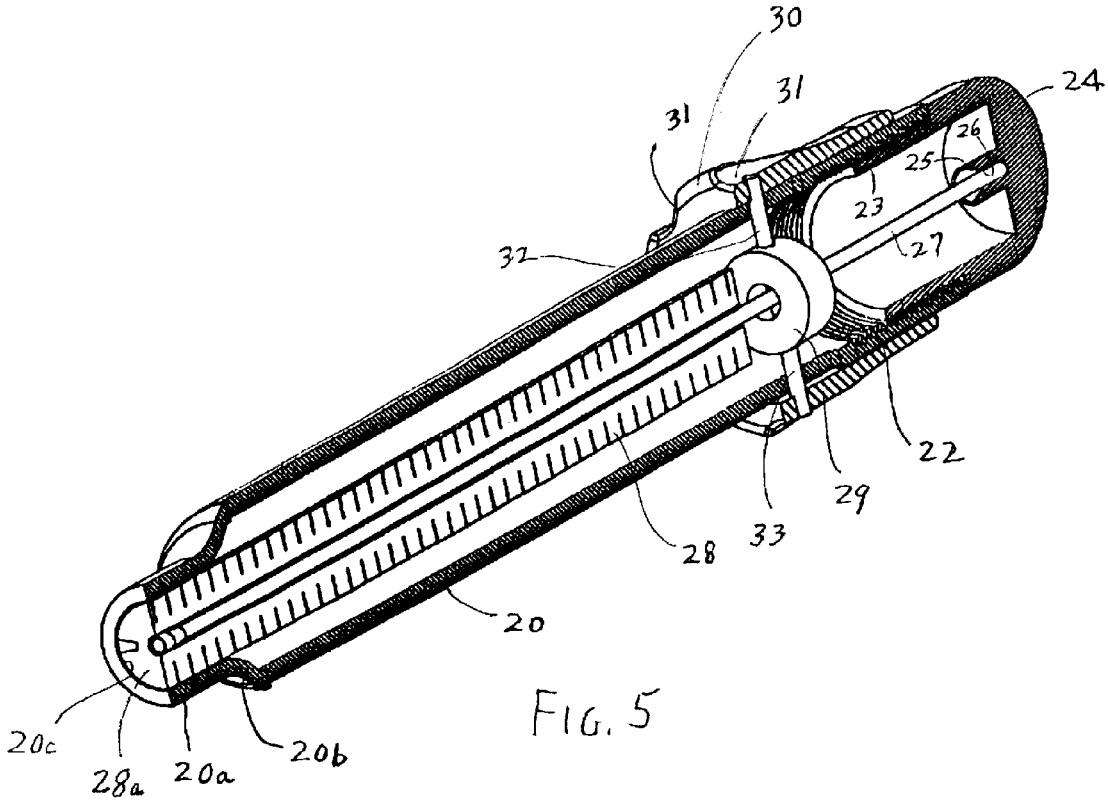
FIG. 5 is a view similar to FIG. 4 and showing the stack of marker disks or stickers sectioned.

The marker implement according to a first embodiment of this invention (FIGS. 1–6) has an elongated housing having a main body 20 which is cylindrical for most of its length and is formed with a pair of diametrically opposed, narrow, longitudinal slots, one of which is shown at 21 in FIGS. 1 and 2. At one end the implement housing presents a cylindrical neck 20*a* which is of smaller diameter than the main part 20 of the housing and is joined to it by a slightly curved, tapered, annular housing segment 20*b*. Neck 20*a* defines a circular opening 20*c* in this end of the implement housing. As shown in FIGS. 4 and 5, the opposite end of the main body 20 of the marker implement is internally screw-threaded at 22 to threadedly receive the externally screw-threaded inner end 23 of a hollow end cap 24 that closes this end of the implement housing. End cap 24 has a centrally located, longitudinally extending internal boss 25 that defines a cylindrical socket 26 which is open toward the main part 20 of the implement housing and is coaxial with it.

An elongated guide rod 27 of solid cylindrical cross-section (FIGS. 4 and 5) is seated at one end with a press fit in socket 26 and extends coaxially of the end cap 24 and the housing body 20 to a circular opening 20*c* at the reduced neck 20*a* on the other end of the housing. A stack of thin, flat, annular, marker disks or stickers 28 is snugly but slidably positioned on guide rod 27 and loosely received in the main body 20 of the implement housing. (The thickness of an individual disk 28 is greatly exaggerated in FIGS. 2–5 for ease of illustration. In one practical embodiment, about 1,000 of the disks or stickers 28 may be in the stack received in the implement housing and disposed on the guide rod 27 as shown.) Each of the disks 28 has a self-adhesive, flat, annular face 28*a* which faces away from the end cap 24 and a non-adhesive, preferably slippery, flat, annular, opposite face engaging the adhesive face 28*a* of the next disk behind it, so that successive marker disks do not stick to each other but may be readily separated from the stack one at a time. The reduced neck 20*a* of housing 20 receives the disks with a snug sliding fit, so that individual marker disks may be dispensed from the marker housing one at a time through its end opening 20*c*.

The marker disks or stickers 28 are dispensed individually from the implement housing 20 by means of a manually-operated actuator arrangement in the marker which comprises:

a pusher in the form of an inner ring 29 which loosely encircles the guide rod 27 and is engageable with the non-adhesive face of the uppermost disk 28 in the stack;

an actuator in the form of an outer ring 30 which is slidably mounted on the outside of the main body 20 of the implement housing and presents a plurality of circumferentially spaced finger-receiving grooves or recesses 31 on the outside to facilitate grasping it;

and a pair of cross pins 32 and 33 connecting the outer ring 30 to the inner ring 29 and slidably received in the respective longitudinal slots 21 in the implement housing.

Figure 6:
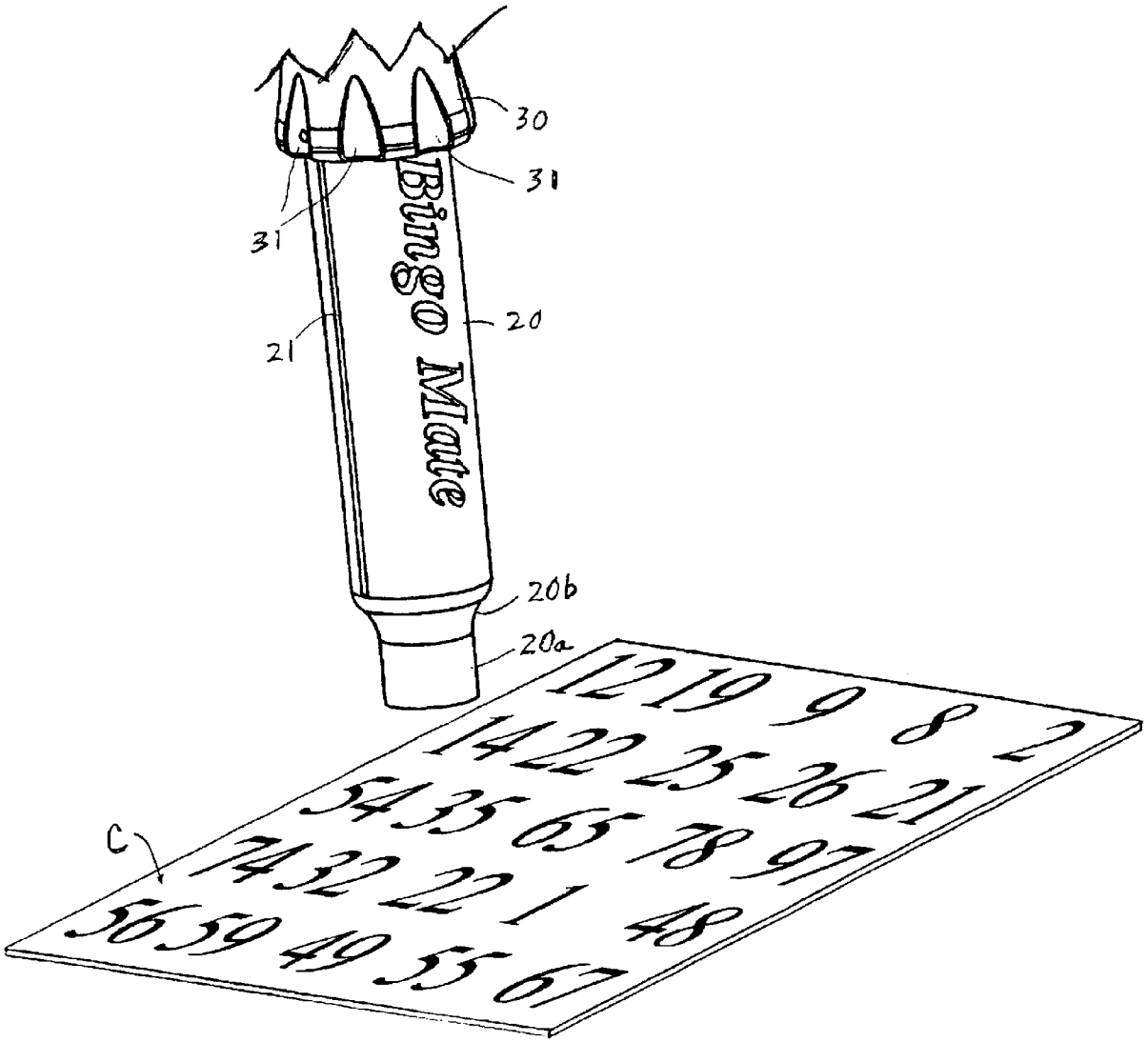
FIG. 6 shows the marker implement of FIGS. 1–5 above a Bingo card preparatory to applying a marker disk or sticker to a selected number on the card.

FIG. 6 shows the marker implement of FIGS. 1–5 held by a Bingo player over a Bingo card C having the usual rectangular array of columns and rows of numbers on its top face. The player holds the marker implement in his or her hand, and by placing the neck 20*a* of the marker against a number on the Bingo card C while urging the outer ring 30 of the actuator implement toward the card with a slight manual force, a single marker disk or sticker 28 is dispensed from the marker implement through the end opening 20*c* with its self-adhesive face down. When the player pulls the marker implement up from the card C, the just-dispensed single marker disk or sticker remains attached to the card, encircling the number selected by the player.

If desired, the player may apply the marker disks individually to numbers on the Bingo card as they are called, in which case the marker disks identify the called numbers, but preferably the player uses a conventional colored pen to mark the numbers on the card C as they are called and uses the marker implement of FIGS. 1–5 to apply marker disks 28 only to those numbers which the player has marked erroneously—i.e., numbers which have not in fact been called.

Figure 7:
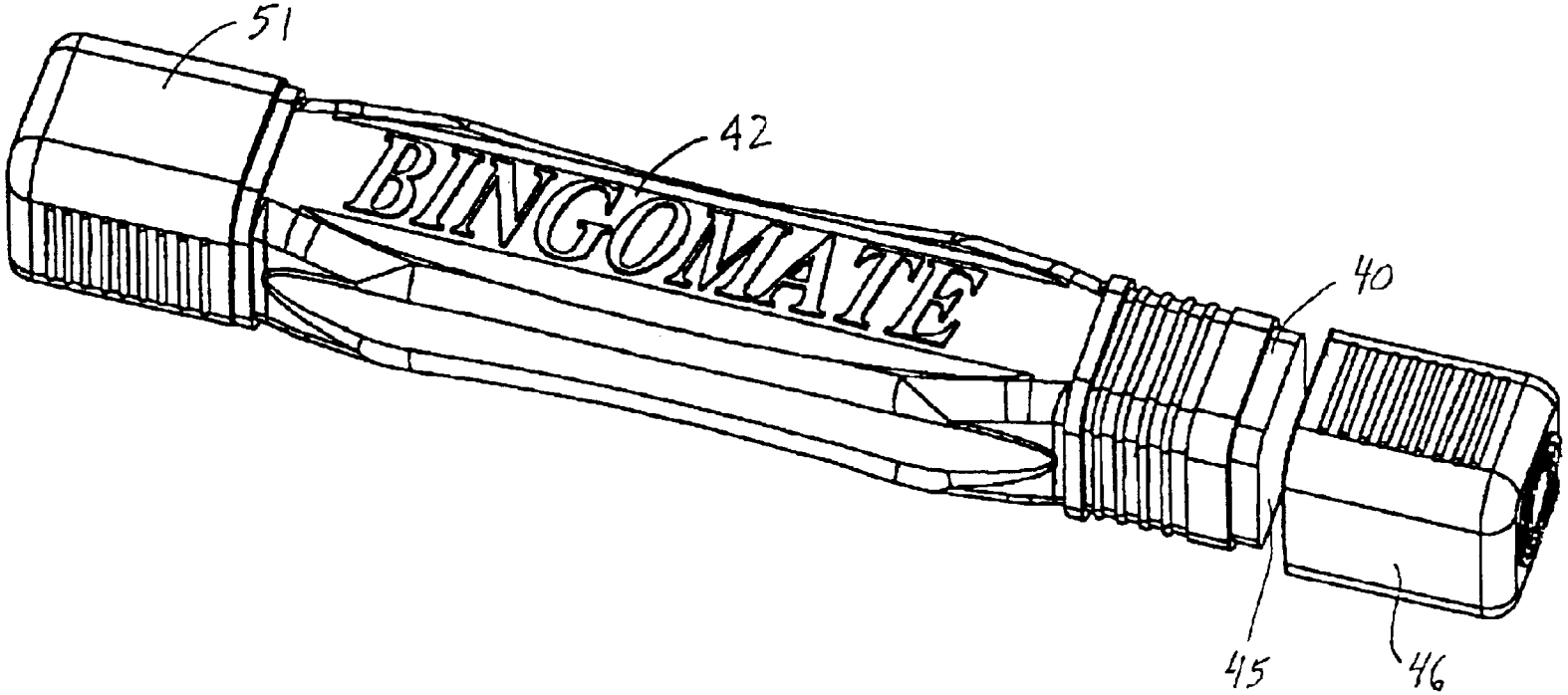
FIG. 7 is a perspective view of a marker implement in accordance with a second embodiment of the present invention.
Figure 8:
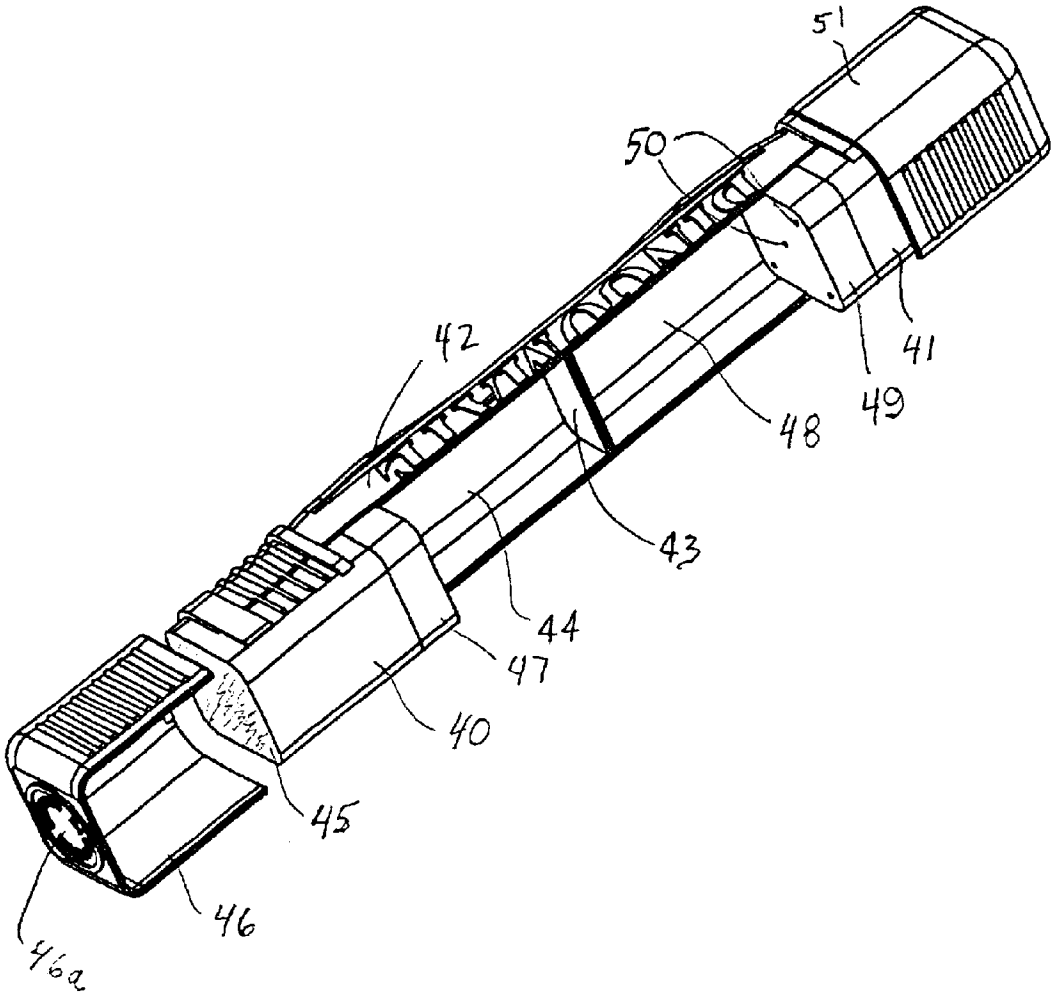
FIG. 8 is a perspective view of this marker implement with its housing broken open and one of its end caps removed.

Second Embodiment—FIGS. 7 and 8

In accordance with a second embodiment of the invention (FIGS. 7 and 8), a marker implement is provided having a first ink pad 40 (FIG. 8) on one end for applying a colored circular mark on the card at any number the player has marked mistakenly on the player's Bingo card and a second ink pad 41 on the opposite end for previously applying a different colored mark in the form of a solid or filled-in square on the game card on the number the player believes at the time to have been just called. This marker implement has an elongated hollow housing 42 that holds the ink pads 40 and 41 at its opposite ends. The implement housing has a divider wall 43 midway along its length.

On one side of wall 43 the implement housing defines a first ink well 44 for holding an ink of a first color that soaks the porous first ink pad 40, which has a permeable membrane 45 on its outer end. A restrictor 47 is located between the fist ink well 44 and the first ink pad 40. This restrictor is formed with a plurality of small passages for conducting ink from well 44 to ink pad 40. An end cap 46 on ink pad 40 presents a circular opening 46*a* immediately outside the ink pad membrane 45 for passing ink from ink pad 40 onto the game card C.

On the opposite side of wall 43 the marker housing defines a second ink well 48 for holding a second ink of a different color from the first. A restrictor 49 located between the second ink well 48 and the second ink pad 41 is formed with small passages 50 for conducting ink from the ink well 48 to this ink pad. An ink pad membrane (not shown) is provided on the outer end of the second ink pad 41. An end cap 51 on this end of the implement housing provides a substantially square opening next to this ink pad's membrane for passing ink from ink pad 41 onto the game card when end cap 51 is pressed against the card.

In using this marker implement when playing Bingo, the player presses end cap 51 against the game card to mark the called numbers promptly after they are called. If the player makes an error by marking a number on his or her card that has not in fact been called, he or she reverses the marker implement end-to-end and presses the end cap 46 against this number on the card to make a circular mark of a different color, thereby reminding the player to disregard the erroneously marked number on the card as the game goes on.

Third Embodiment—FIGS. 9–12

The third embodiment of the present invention (FIGS. 9–12) comprises an elongated marker implement housing 50 carrying a stamp 51 on one end (FIGS. 10–12) for producing a square mark on a selected number on the Bingo card C, as well as a stamp 61 on the opposite end (FIG. 10) for producing a circular mark on the card.

Figure 9:
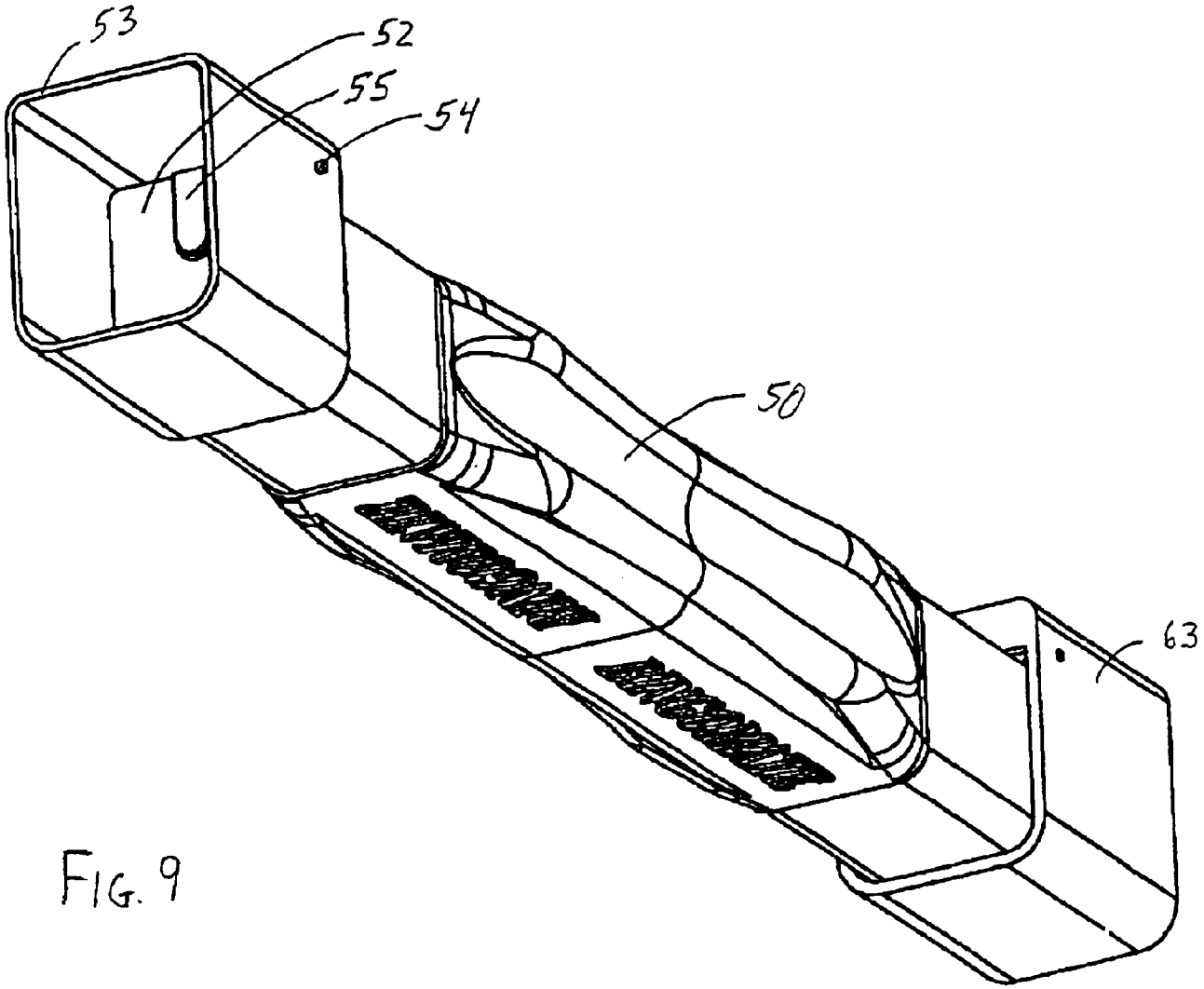
FIG. 9 is a perspective view of a marker implement in accordance with a third embodiment of the invention.
Figure 10:
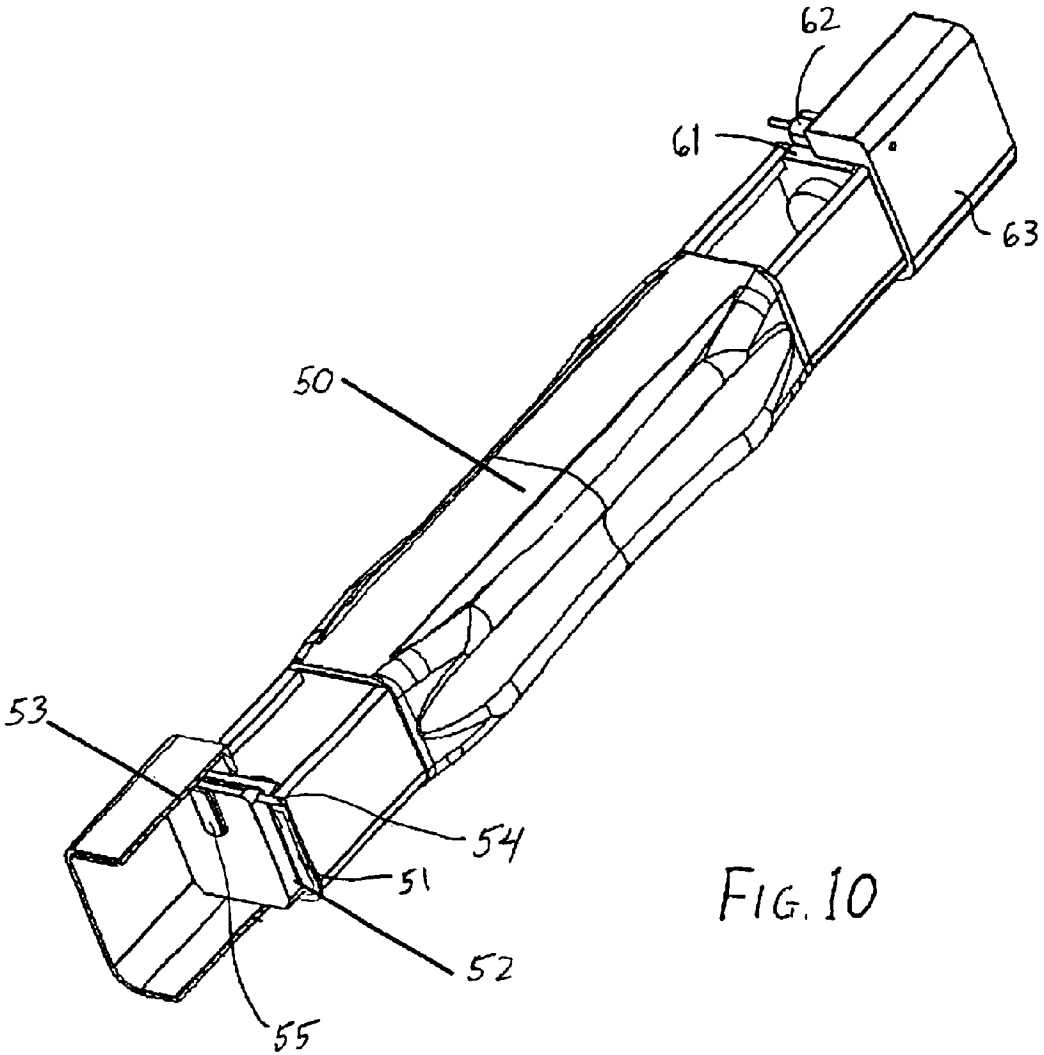
FIG. 10 is a similar view of this marker implement with its slider at one end broken away to show the ink pad at that end engaging a stamp there.

Stamp 51 is supplied with ink of one color from an ink pad 52 pivotally coupled to a slider 53 which sidably surrounds the implement housing at this end and is reciprocable on it between an extended lock position (FIGS. 9 and 10), in which it projects beyond the stamp 51 and positions the ink pad 52 in contact with this stamp to supply it with ink, and a retracted open position (FIG. 12), in which it disengages the ink pad 52 from stamp 51 and exposes this stamp so that the player may use it to mark the card C. A cross pin 54 pivotally couples ink pad 52 to slider 53. A leaf spring 55 acts between slider 53 and ink pad 52 to hold the ink pad against the outer face of stamp 51 when the slider is in the lock position (FIGS. 9 and 10).

Figure 11:
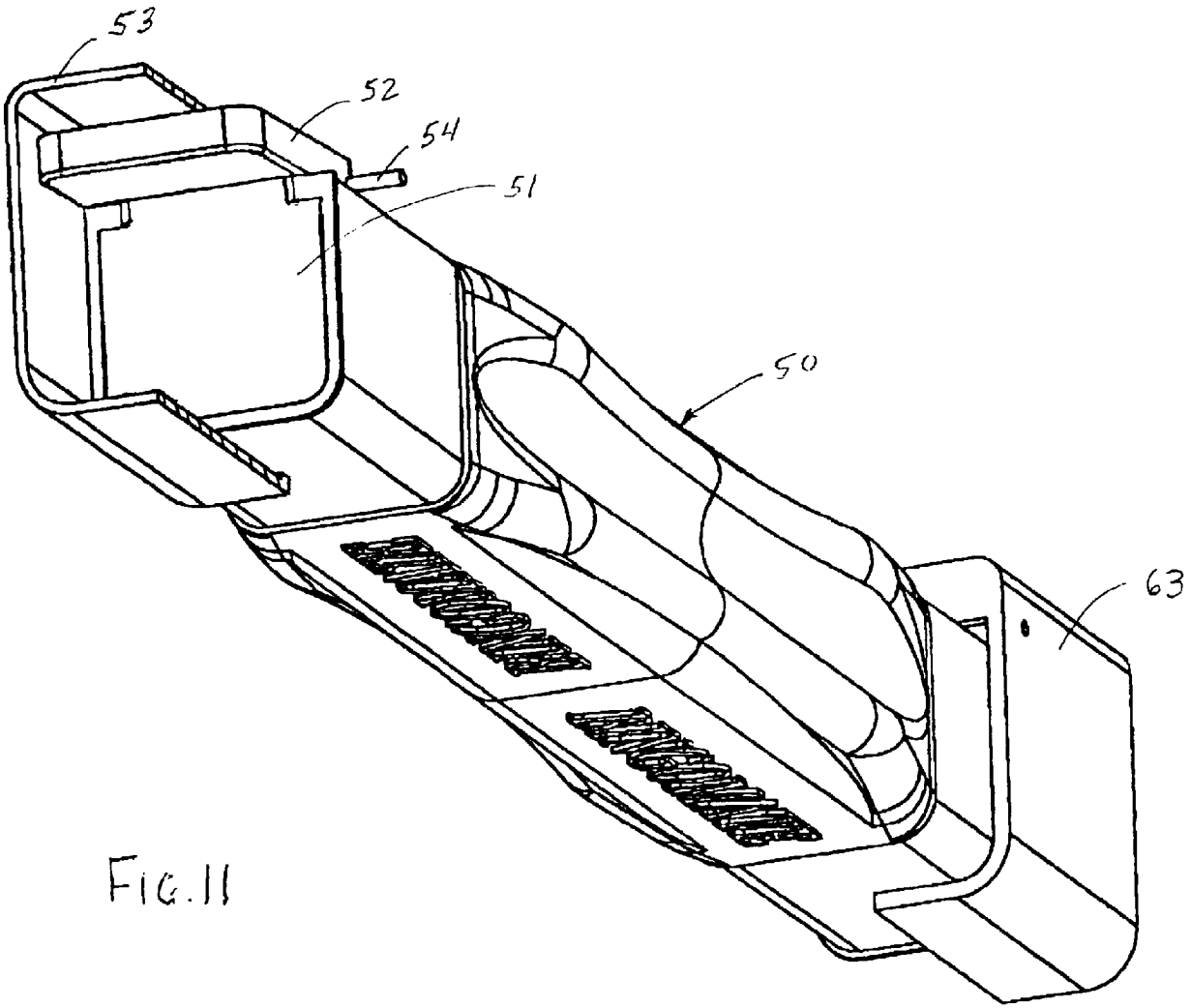
FIG. 11 is a view similar to FIG. 10 with the slider partially retracted and moving the ink pad away from the corresponding stamp.
Figure 12:
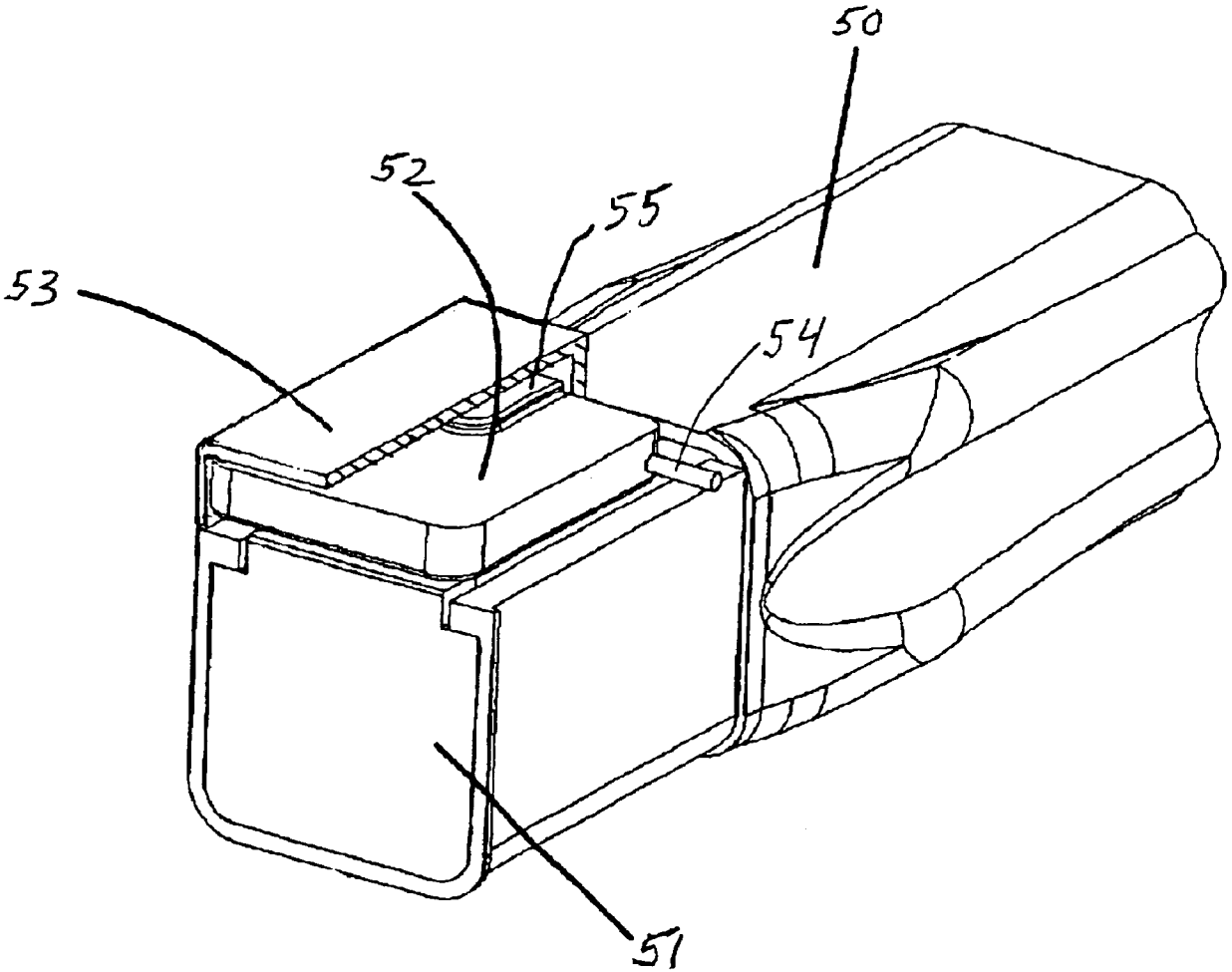
FIG. 12 is a similar view showing that slider fully retracted and positioning the corresponding ink pad away from inking engagement with the stamp on that end of the marker implement.

When the player manually retracts slider 53 from its extended lock position, the ink pad 52 rotates a quarter turn inside the slider and slides across the top of the marker housing 50, as shown in FIG. 11, until the slider reaches the fully retracted position (FIG. 12), in which the inked outer face of stamp 51 protrudes slightly beyond the outer edge of slider 53 and thus can be used to mark the Bingo card.

An identical inking mechanism is provided on the opposite end of marker housing 50, with a slider 63 carrying a pivoted ink pad 62 (FIG. 10) that is spring-biased against a stamp 61 on that end in the same manner as described and shown for ink pad 52 and stamp 51. Stamp 61 is designed to produce an error-designating circular ink mark on the player's Bingo card after the player retracts slider 63 from its extended lock position, as described for mechanism 51–55.

From the foregoing description and the accompanying drawings, it will be evident that the present invention can be embodied in a variety of different marker implements capable of producing a distinctive mark on a bingo card at any number the player has marked in error, either by using a separate marker or by using the opposite end of the same marker implement the player is using to produce the error marking.

We claim:

1. A marker implement for use with a game card having numbers thereon to be marked by a player as they are called, said marker implement comprising: an elongated implement housing shaped and dimensioned to be held in a player's hand and having opposite ends; and means in said implement housing operable in response to pressing one of said ends of said implement housing against the game card for depositing a marker of a distinctive color and shape at a number on the game card previously marked erroneously by the player.

2. A marker implement according to claim 1 wherein: said implement housing has a longitudinal chamber that is open at said one end of the housing, and further comprising: a plurality of disk-shaped markers stacked face-to-face in succession along said chamber, each of said markers having a self-adhesive face toward said open end of said chamber;

and manually operable means for dispensing said markers one at a time through said open end of said chamber onto said erroneously marked number on the game card.

3. A marker implement according to claim 2 wherein: each of said markers is a thin, flat, annular disk with a non-adhesive surface on its opposite face from said self-adhesive face.

4. A marker implement according to claim 3 wherein said means for dispensing said markers from the implement housing comprises: a pusher inside said chamber engaging the opposite end of the marker stack from said open end of the implement chamber; and a manually engageable actuator slidably mounted on the outside of said implement housing and coupled to said pusher for urging said pusher against the marker stack to apply to the game card the marker disk at said open end of said chamber in the implement housing.

5. A marker implement according to claim 4, and further comprising a guide rod for said stack of annular disks in said chamber extending longitudinally of the implement housing.

6. A marker implement according to claim 5 wherein: said pusher is an inner ring disposed inside said chamber and surrounding said guide rod; and said manually engageable actuator is an outer ring slidable along the outside of said implement housing.

7. A marker implement according to claim 3 wherein: said chamber in the implement housing loosely receives said stack of marker disks for most of the length of said stack, and said chamber adjacent said open end thereof is shaped and dimensioned to snugly but slidably receive the marker disks.

8. A marker implement according to claim 7 wherein said means for dispensing said markers from the implement housing comprises: a pusher inside said chamber engaging the opposite end of the marker stack from said open end of the implement chamber; and a manually engageable actuator slidably mounted on the outside of said marker housing and coupled to said pusher for urging said pusher against the marker stack to apply to the game card the marker disk at said open end of said chamber in the implement housing.

9. A marker implement according to claim 8, and further comprising a guide rod for said stack of annular disks in said chamber extending longitudinally of the implement housing.

10. A marker implement according to claim 9 wherein: said pusher is an inner ring disposed inside said chamber and surrounding said guide rod; and said manually engageable actuator is an outer ring slidable along the outside of said implement housing.

11. A marker implement according to claim 1, and further comprising means for depositing from the opposite end of said marker housing a marker of different color and shape on the game card.

12. A marker implement according to claim 11 wherein: both of said markers are ink.

13. A marker implement according to claim 12 wherein: said manually operated means for depositing said ink markers comprise respective ink applying means located at the opposite ends of said implement housing.

14. A marker implement according to claim 13 wherein: each of said ink applying means comprises an ink pad and a cover for said pad having an opening for depositing ink from the corresponding ink pad onto the game card; and said housing defines separate ink wells arranged to supply inks to said pads individually.

15. A marker implement according to claim 13 wherein each of said ink applying means comprises: a stamp on the corresponding end of the implement housing; an ink pad for inking contact with said stamp to apply ink thereto; a slider reciprocably mounted on said implement housing for movement between an extended position projecting beyond the corresponding stamp and a retracted position exposing said stamp for contact with the game card; and means coupling said slider to the corresponding ink pad to position said ink pad in inking contact with the corresponding stamp in said extended position of the slider and to position said ink pad out of inking contact with said stamp in said retracted position of the slider.

16. A marker implement according to claim 15 wherein said coupling means provides a pivotal mounting of said ink pad on said slider.

17. A marker implement according to claim 16, and further comprising spring means biasing said ink pad against said stamp in said extended position of the slider.

* * * * *